US005973660A

United States Patent [19]

Hashimoto

[11] Patent Number: 5,973,660

[45] Date of Patent: Oct. 26, 1999

[54] MATRIX LIQUID CRYSTAL DISPLAY

[75] Inventor: Yoshiharu Hashimoto, Tokyo, Japan

[73] Assignee: NEC Corporation, Tokyo, Japan

[21] Appl. No.: 08/915,143

[22] Filed: Aug. 20, 1997

[30] Foreign Application Priority Data

Aug. 20, 1996 [JP] Japan ..... 8-218708

[51] Int. Cl.[6] ..... G09G 3/36

[52] U.S. Cl. ..... 345/98; 345/204

[58] Field of Search ..... 345/87, 89, 98, 345/94–96, 100, 204, 208, 210

[56] References Cited

U.S. PATENT DOCUMENTS 5,748,165 5/1998 Kubota et al. ..... 345/96

FOREIGN PATENT DOCUMENTS 63-304229 12/1988 Japan .
6-348235 12/1994 Japan .
7-130193 5/1995 Japan .
8-137443 5/1996 Japan .

OTHER PUBLICATIONS

F. Kato, et al, "17.1: An 8–bit Digital Data Driver for Color TFT–LCDs", SID 96 Digest, 1996, pp. 247–250.

K. Meinstein, et al. "17.3: A Low Voltage Source Driver for Column Inversion Applications", SIC 96 Digest, 1996, pp. 255–258.

*Primary Examiner*—Regina Liang

*Attorney, Agent, or Firm*—Whitham, Curtis & Whitham

[57] ABSTRACT

A liquid crystal drive circuit has two circuit configurations for supplying one half the liquid crystal drive voltage. Also, the two circuits of the liquid crystal drive circuit section are shared by two terminals. The apparatus is controlled by a switch in such a manner that voltages are maintained at positive and negative amplitude levels between the two terminals based on the voltage Vcom of a common terminal of the liquid crystal to drive the liquid crystal in AC drive.

14 Claims, 12 Drawing Sheets

WHEN POLARITY SIGNAL POL IS H LEVEL

WHEN POLARITY SIGNAL POL IS L LEVEL

WHEN LATCH SIGNAL STB IS H LEVEL

MATRIX LIQUID CRYSTAL DISPLAY

BACKGROUND OF THE INVENTION

1. Field of the Invention

The present invention relates to a matrix liquid crystal display.

2. Description of the Related Art

In the case where the liquid crystal is driven by applying to it a video signal in conventional matrix liquid crystal display, an AC drive is required in which positive and negative voltages are alternately applied to a common electrode of the liquid crystal in order to prevent the deterioration of the liquid crystal. FIG. 1 is a block diagram showing a liquid crystal drive circuit used for a conventional matrix liquid crystal display configured as an integrated circuit.

The liquid crystal drive circuit shown in FIG. 1 includes a shift register 21, a first latch circuit 22 for latching n-bit video data from the shift register 21 in parallel, a second latch circuit 23 for latching the data output from the first latch circuit by a latch signal, a decoder 24 and a level shifter 25 for selecting $2^n$ gray-level voltages supplied the n-bit video data from an external source, and $2^n$ analog switches 26 (JP-A-63-304229).

Each output terminal of the liquid crystal drive circuit selects one value from the $2^n$ gray-level voltages and applies a predetermined gray-level voltage to the liquid crystal. In the process, in order to drive the liquid crystal in AC drive, the gray-level voltage applied to the liquid crystal has conventionally been changed for each line or each frame of the matrix liquid crystal.

In this liquid crystal drive circuit, a voltage twice as high as the threshold voltage of the liquid crystal is required for applying positive and negative voltages alternately to a common electrode of the liquid crystal. The threshold voltage of the liquid crystal is normally about 4 to 5 volts. For AC drive, therefore, the liquid crystal drive circuit is required to have a breakdown voltage of at least 10 V. In view of this, a diffusion process of high breakdown voltage has conventionally been used for fabricating an integrated liquid crystal drive circuit.

In the case where the liquid crystal drive circuit for the matrix liquid crystal display shown in FIG. 1 is fabricated as an integrated circuit, the use of a diffusion process of high breakdown voltage poses the problem of a large chip size. This is attributable to the fact that the diffusion process of high breakdown voltage requires a long gate, a thick gate oxide film and a low-concentration layer for increasing the breakdown voltage of a transistor. Further, component elements are required to be isolated from each other, thereby leading to a large transistor size.

Further, when the liquid crystal drive circuit shown in FIG. 1 is fabricated as an integrated circuit, a long diffusion process leads to the problem of a higher chip cost. The reason is that the recent trend toward a matrix liquid display apparatus of higher definition is so marked that the logic unit of the liquid crystal drive circuit requires a high operating speed of at least 40 MHz. Also, the driver unit, which AC drives the liquid crystal, requires a breakdown voltage of not less than 10 V. As a result, a process of a low breakdown voltage (5 V) mixes with a process at a high breakdown voltage (10 V or more), so that the diffusion process is longer than the process at low breakdown voltage.

Another problem of the prior art is a large power consumption. This is because a voltage at least twice as high as the threshold voltage of the liquid crystal is required to be applied to the voltage source of the liquid crystal drive circuit.

SUMMARY OF THE INVENTION

An object of the present invention is to provide a matrix liquid crystal display which is compact and consumes less power and able to AC drive the liquid crystal in a wide dynamic range.

In order to achieve the above-mentioned object, according to one aspect of the invention, there is provided a matrix liquid crystal display comprising a plurality of liquid crystal drive circuits and a plurality of switch circuits. The liquid crystal drive circuits have double circuit configurations for producing positive and negative voltages on the basis of a voltage of one half as high as the supplied liquid crystal drive voltage or on the basis of a voltage of the common electrode of the liquid crystal in accordance with the applied video data. The switch circuits have two terminals thereof sharing the two liquid crystal drive circuits and are controlled in such a manner as to produce a voltage for maintaining the relation of positive and negative amplitudes between the two terminals.

The breakdown voltage of those switch circuits directly connected to the liquid crystal is set to a level at least twice as high as the threshold voltage of the crystal.

Further, the liquid crystal drive circuit has two types of operational amplifiers having differential input stages configured of transistors of different conduction types.

Furthermore, the liquid crystal drive circuit includes two gray-level voltage generating circuits for finely adjusting the gray-level voltage for display on the liquid crystal on the basis of an input from an external source.

In addition, the liquid crystal drive circuit includes two level shift circuits for increasing the liquid crystal drive voltages to different levels.

Also, the gray-level voltage generating circuit finely adjusts the gray-level voltage to such a resistance ratio as to meet the $\gamma$ curve of the liquid crystal according to the resistance dividing scheme.

Further, the switch circuit includes a common terminal switch, which is shared by all the output terminals of the liquid crystal drive circuit thereby to reduce the voltage of all the output terminals to one half of the liquid crystal drive voltage.

According to this invention, the liquid crystal drive circuit for driving the matrix liquid crystal and displaying the data includes two circuits groups. For driving the liquid crystal in AC drive, positive and negative voltages are applied alternately, and therefore the liquid crystal drive circuit requires a breakdown voltage at least twice as high as the threshold voltage of the liquid crystal.

The present invention comprises two circuit groups, one set to a low voltage and the other to a high voltage in isolation from each other. As compared with the case in which a voltage at least twice as high as the threshold voltage level of the liquid crystal is handled by one group of circuits, therefore, the invention in which the voltage is burned by the two circuit groups can set a low breakdown voltage for each circuit, with the result that the liquid crystal drive circuit can be fabricated using the diffusion process of low breakdown voltage.

Also, two operational amplifiers are alternately used by being controlled by a switch on time basis, and therefore the liquid crystal can be arranged on one side for dot inversion drive (FIG. 14B) over a wide dynamic range with a high drive capability.

DETAILED DESCRIPTION OF THE PREFERRED EMBODIMENTS

Now, preferred embodiments of the present invention will be explained below.

Figure 1:
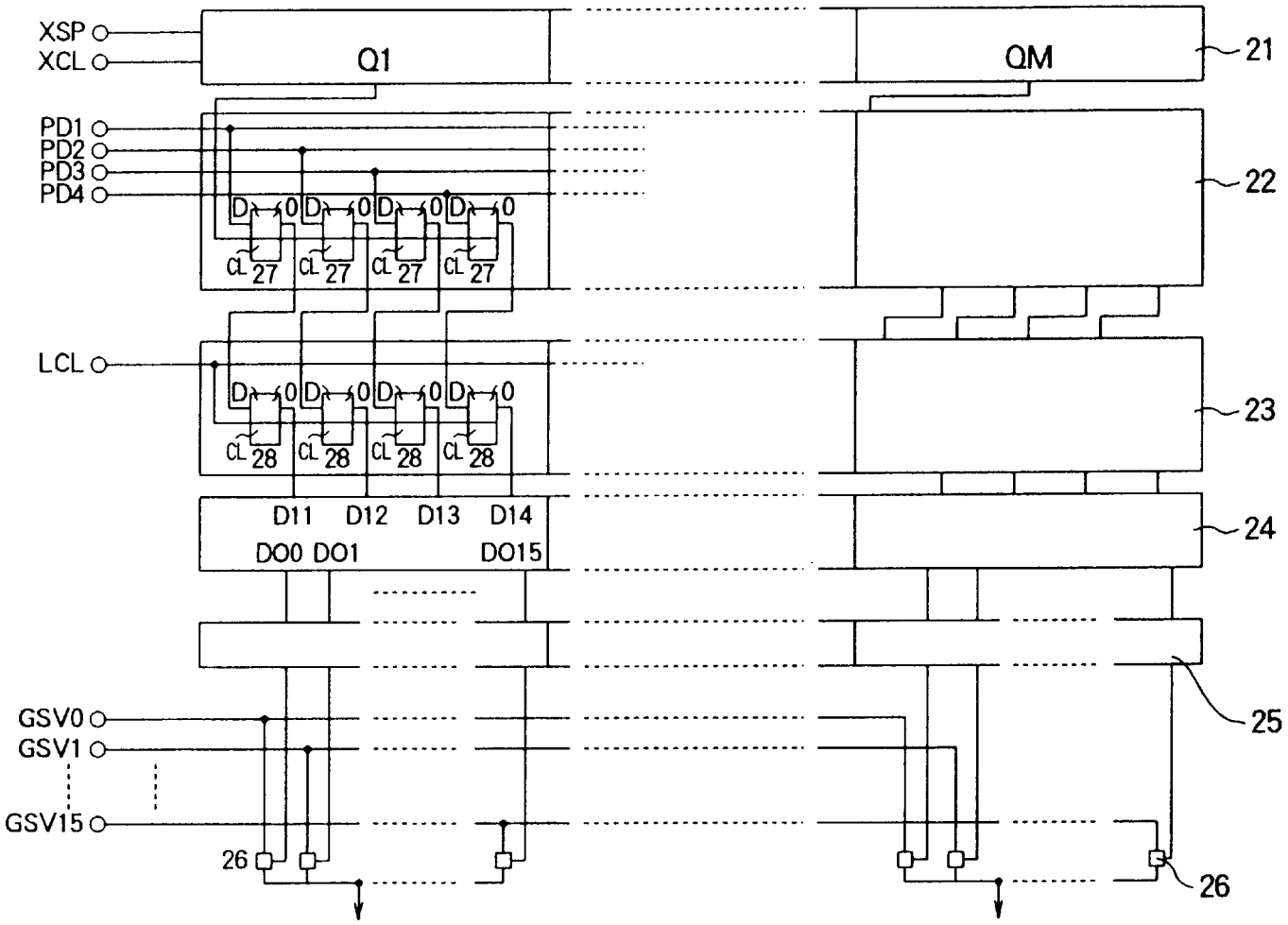
FIG. 1 PRIOR ART
FIG. 1 is a block diagram showing a circuit configuration of a conventional matrix liquid crystal display.
Figure 2:
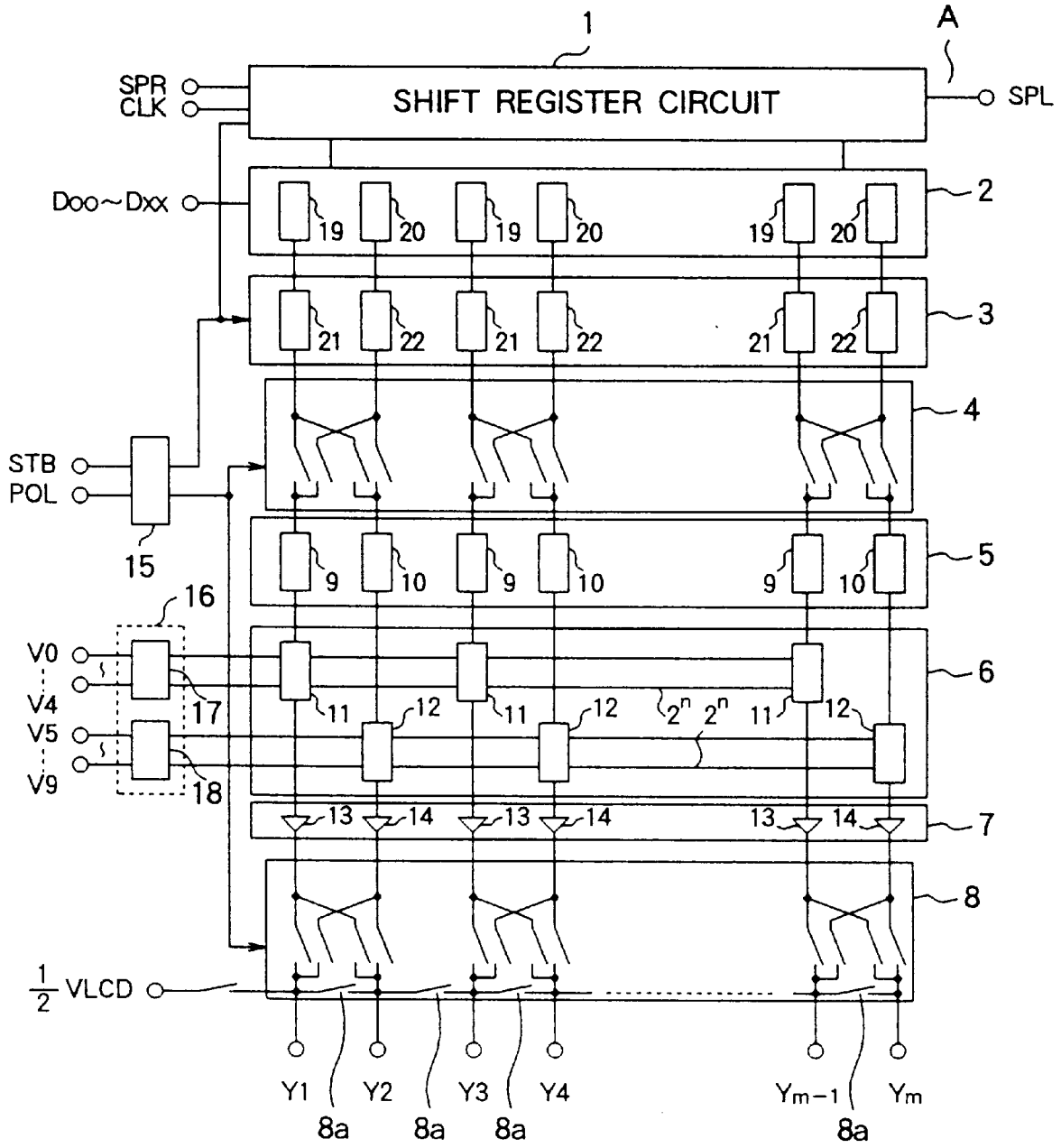
FIG. 2 is a block diagram showing a circuit configuration of a matrix liquid crystal display according to a first embodiment of the present invention.

FIG. 2 is a block diagram showing a matrix liquid crystal display according to a first embodiment of the invention.

Figure 14A:
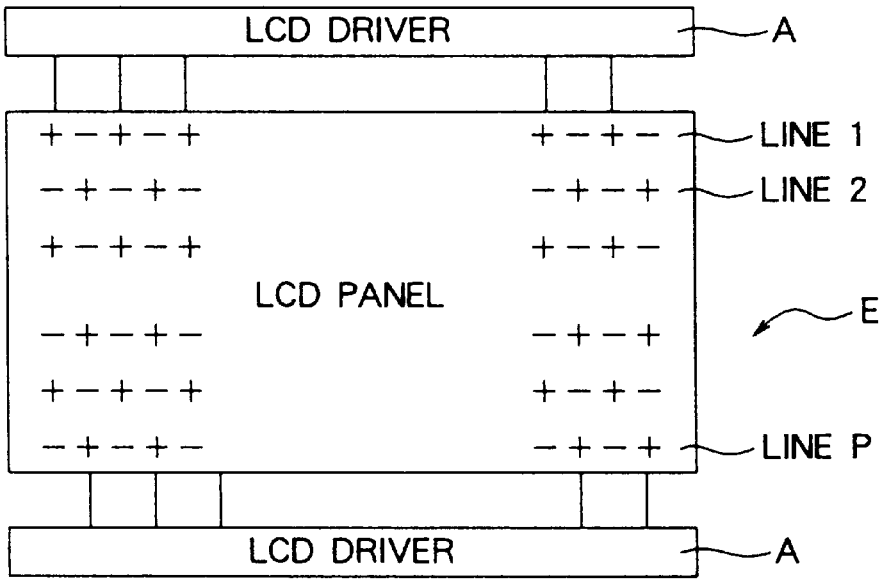
FIG. 14A is a diagram showing a configuration of a packaged liquid crystal with LCD drivers arranged on two sides for dot inversion drive.
Figure 14B:
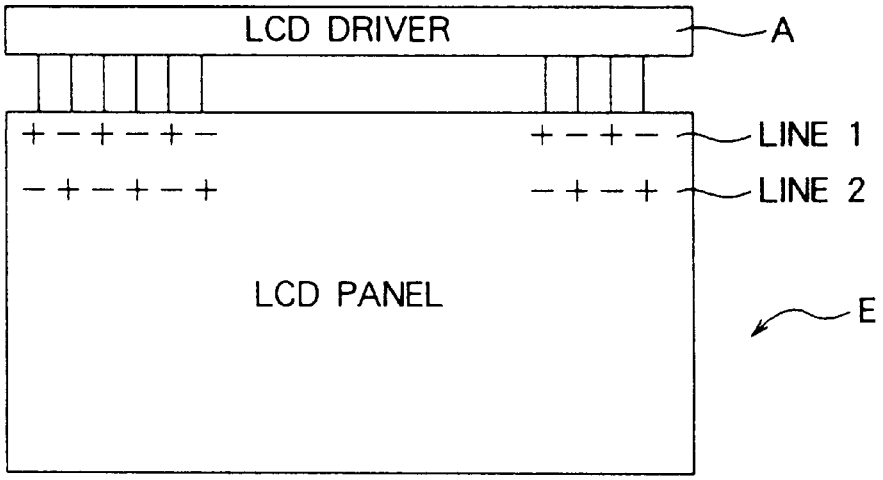
FIG. 14B is a diagram showing a configuration of a packaged liquid crystal with an LCD driver arranged on one side for dot inversion drive.

In FIG. 2, a matrix liquid crystal display according to the first embodiment of the invention comprises a liquid crystal drive circuit A and switch circuits 4, 8. The liquid crystal E of the matrix liquid crystal display is configured of a liquid crystal drive circuit arranged on the two sides thereof for dot inversion drive as shown in FIG. 14A, or configured of a liquid crystal drive circuit A on one side thereof for dot inversion drive as shown in FIG. 14B. The present invention is most suitably applicable to the configuration of FIG. 14B with a liquid crystal drive circuit arranged on one side thereof for dot inversion drive, but is applicable also to the configuration of FIG. 14A with the liquid crystal drive circuits arranged on the two sides of the liquid E for dot inversion drive.

The liquid crystal drive circuit A outputs a negative or a positive voltage on the basis of a voltage one half the liquid crystal drive voltage supplied or on the basis of a voltage Vcom of a common electrode of the liquid crystal. The liquid crystal drive circuit A includes a shift register circuit 1, a data register circuit 2, a latch circuit 3, a level shift circuit 5, a decoder/gray-level voltage select circuit 6, a gray-level voltage generating circuit 16 and an operational amplifier 7. This circuit configuration is divided into two groups. According to this invention, a voltage not lower than the voltage Vcom of the common electrode of the liquid crystal is applied as a positive voltage, while a voltage not higher than the voltage Vcom is regarded as a negative voltage. In this way, the positive-negative relation between amplitude voltages is maintained to secure AC drive.

The data register circuit section 2 is for latching in parallel the n-bit data (n: integer) controlled by the output of each stage of the shift register circuit 1. There are provided a total of m data register circuits including pairs of a data register circuit 19 and a data register circuit 20.

The latch circuit section 3 is for latching the n-bit data from the data register circuit 2 in response to a latch signal, and includes m latch circuits including pairs of a latch circuit 21 and a latch circuit 22.

The level shift circuit section 5 is for boosting the n-bit data from the latch circuit section 3 to different voltage values, and includes m level shift circuits including pairs of a high-voltage level shift circuit 9 and a low-voltage level shift circuit 10. According to this embodiment, the high-voltage shift circuit 9 is adapted to boost the voltage from 3.3 V to 10 V, for example, and the low-voltage level shift circuit 10 is set to boost the voltage from 3.3 V to 5 V, for example. The invention, however, is not limited to these boosting rate. Also, the switch circuit section 4 is adapted for connecting the output of the two latch circuits including the latch circuit 21 and the latch circuit 22 selectively to the high-voltage level shift circuit 9 or the low-voltage level shift circuit 10 on the basis of a control signal from a timing control circuit 15.

Figure 3A:
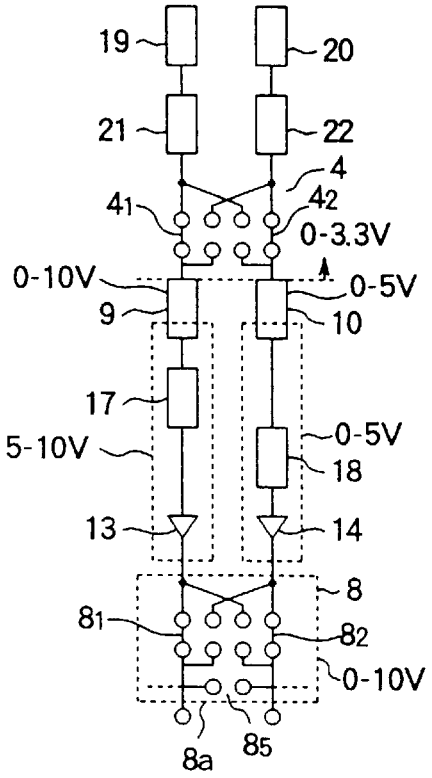
FIGS. 3A, 3B and 3C are characteristic diagrams showing the manner in which the circuit shown in FIG. 2 is controlled for each timing.

Specifically, the switch circuit section 4 is adapted to connect the latch circuit 21 to the high-voltage level shift circuit 9 and the latch circuit 22 to the low-voltage level shift circuit 10 when the polarity signal POL is at "high" (H) level as shown in FIG. 3A. Conversely, the switch circuit section 4 acts to connect the latch circuit 21 to the low-voltage level shift circuit 10 and the latch circuit 22 to the high-voltage level shift circuit 9 when the polarity signal POL is at "low" (L) level as shown in FIG. 3A.

Figure 8:
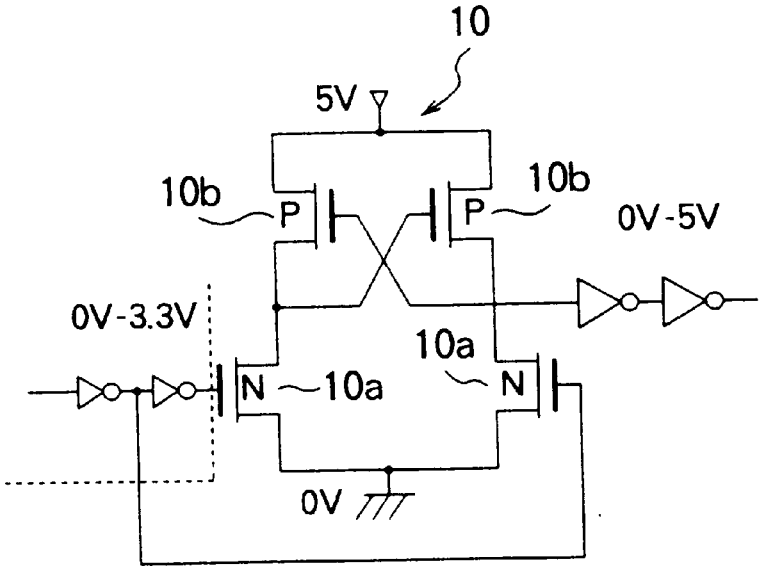
FIG. 8 is a circuit diagram showing a specific circuit configuration of a low-voltage level shift circuit.
Figure 9:
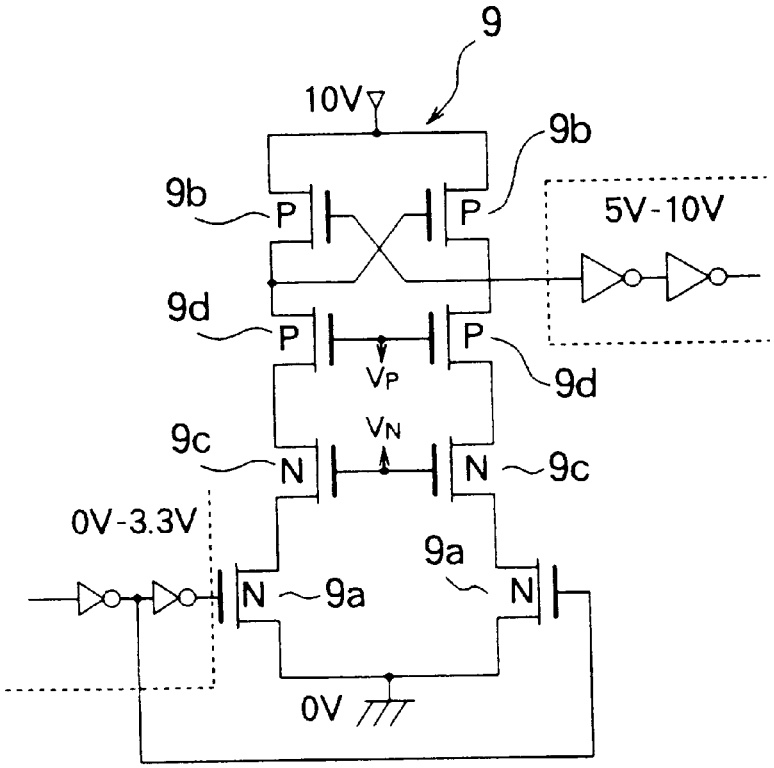
FIG. 9 is a circuit diagram showing a specific circuit configuration of a high-voltage level shift circuit.

Specific examples of the level shift circuit 5 are shown in FIGS. 8 and 9. FIG. 8 shows the low-voltage level shift circuit 10, and FIG. 9 shows the high-voltage level shift circuit 9. The low-voltage level shift circuit 10 shown in FIG. 8 includes a differential pair of N-type field effect transistors (FET) 10*a* and a pair of P-type FETs 10*b* making up a Current Mirror Circuit. The outputs of the latch circuits 21, 22 are applied to the differential pair of the N-type FETs 10*a* for producing an output signal proportional to the difference between the two inputs thereto.

The high-voltage level shift circuit 9 shown in FIG. 9, on the other hand, includes a differential pair of N-type FETs 9*a*, 9*c* and a pair of P-type FETs 9*d* and a pair of P-type FETs 9*b* constituting a Current Mirror Circuit. The outputs of the latch circuits 21, 22 are applied to the differential pair of the N-type FETs 9*a* thereby to produce an output signal amplified in proportion to the difference between the two input signals thereto.

Figure 5:
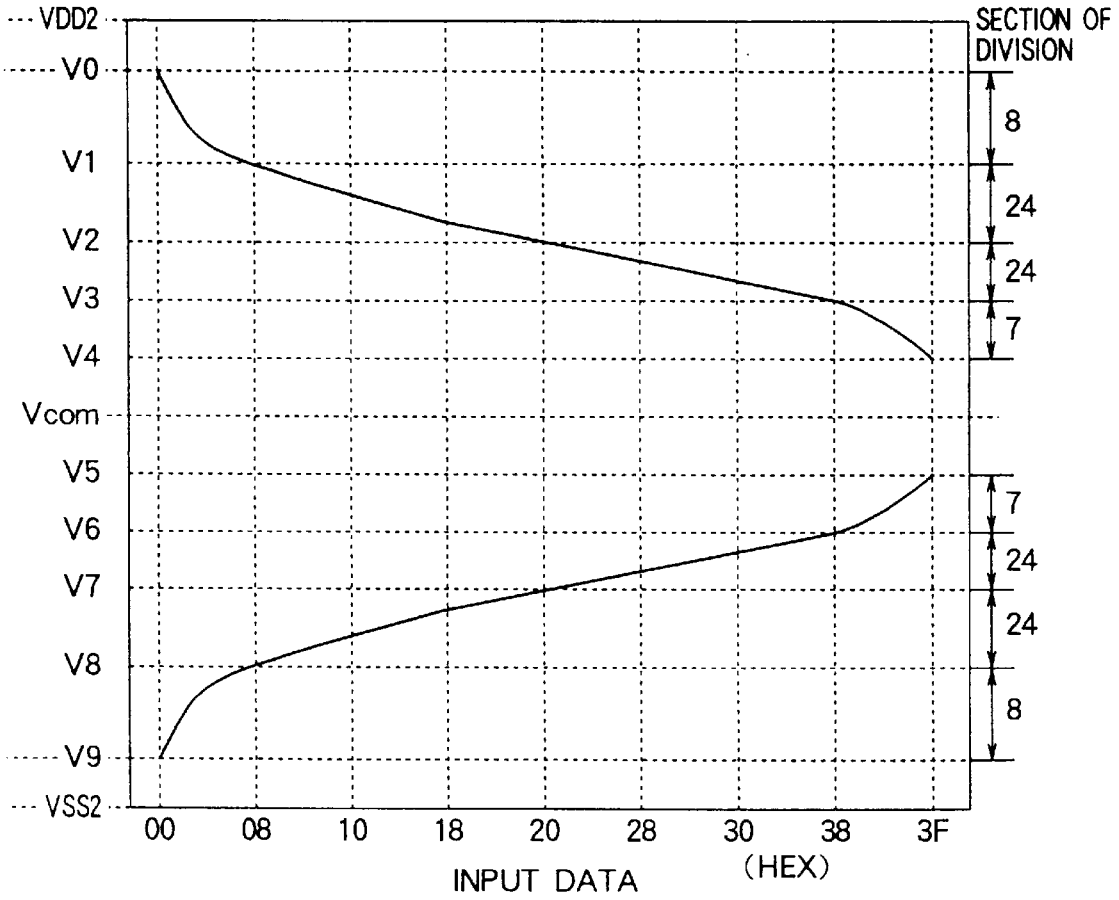
FIG. 5 is a characteristic diagram showing the correlation between input data and output voltage of a gray-level voltage generating circuit.
Figure 6:
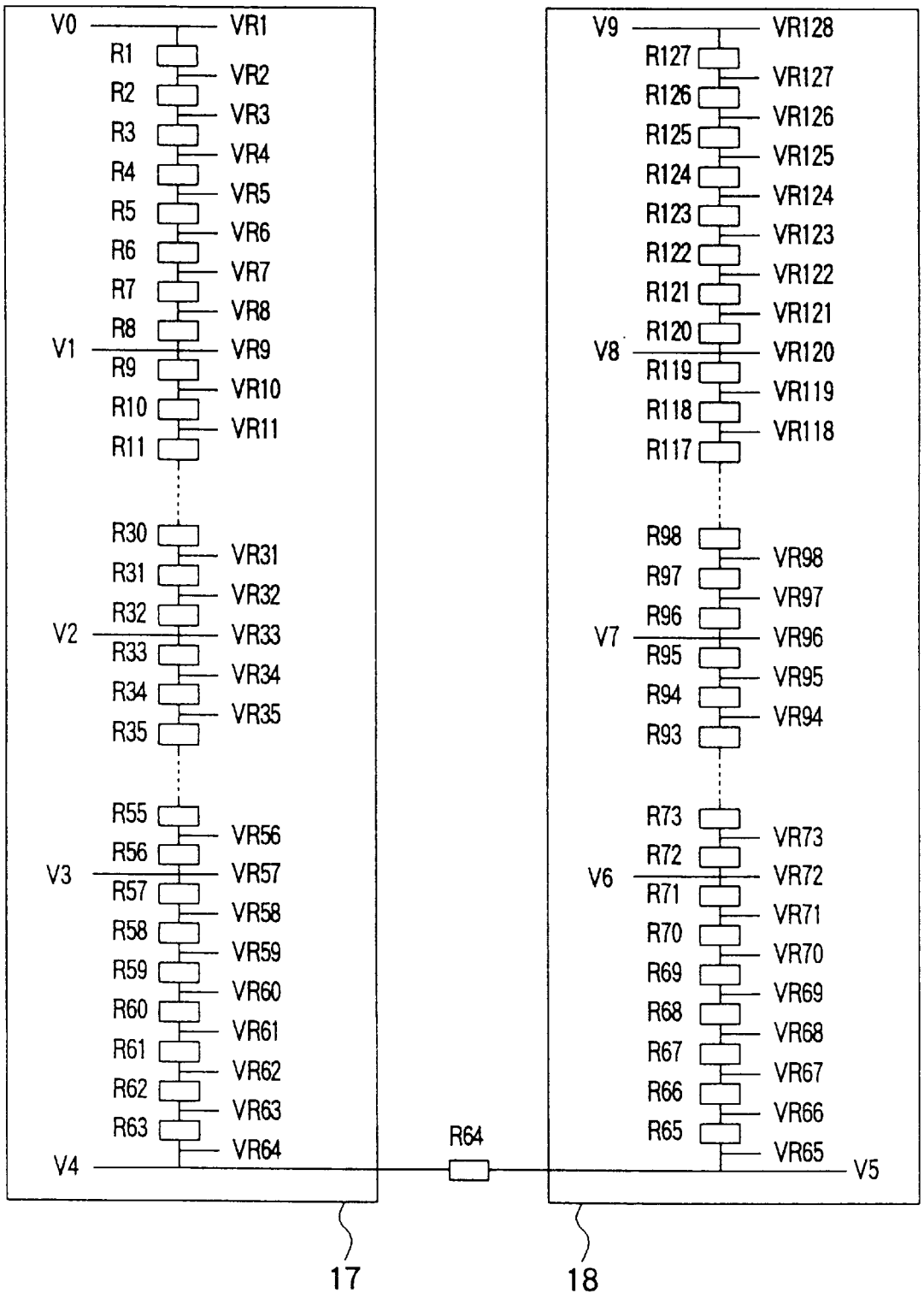
FIG. 6 is a circuit diagram showing a specific circuit configuration of a gray-level voltage generating circuit.

Also, the gray-level voltage generating circuit 16, as shown in FIGS. 2 and 6, includes a high-voltage side gray-level voltage generating circuit 17 and a low-voltage side gray-level voltage generating circuit 18. The gray-level voltage of the gray-level voltage generating circuits 17, 18 for indicating the gray-level to the liquid crystal in accordance with external inputs V0, V1, V2, V3, V4, V5, V6, V7, V8, V9 are finely adjusted in $2^n$ values. Also, the graylevel voltage of the gray-level voltage generating circuits 17, 18 is finely adjusted to the resistance ratio in such a manner as to adapt to the γ curve of the liquid crystal by the resistance dividing method on the basis of the external inputs V0, V1, V2, V3, V4, V5, V6, V7, V8, V9 as shown in FIGS. 5 and 6.

Figure 7:
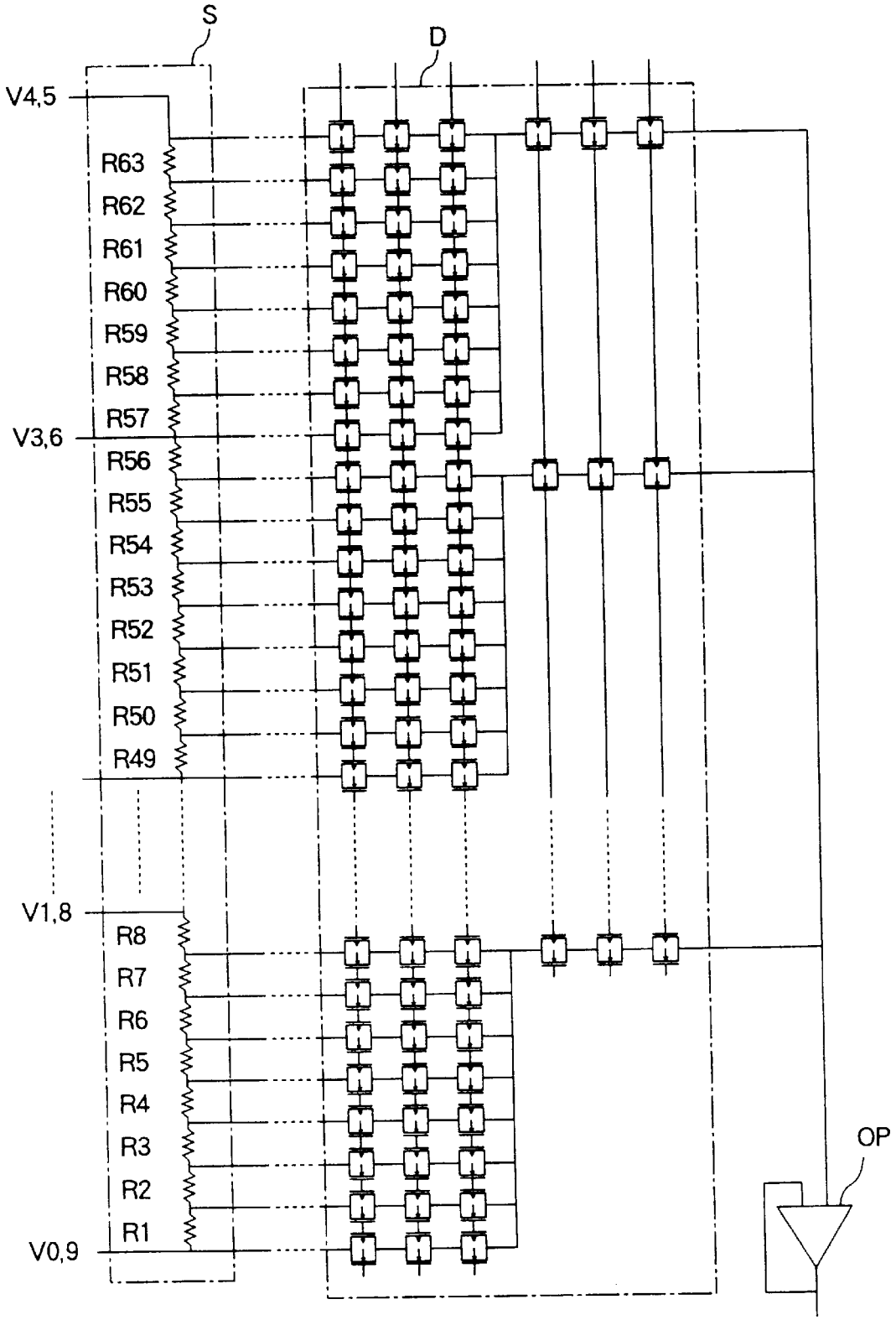
FIG. 7 is a circuit diagram showing a specific circuit configuration of a decoder/gray-level voltage select circuit.
Figure 10:
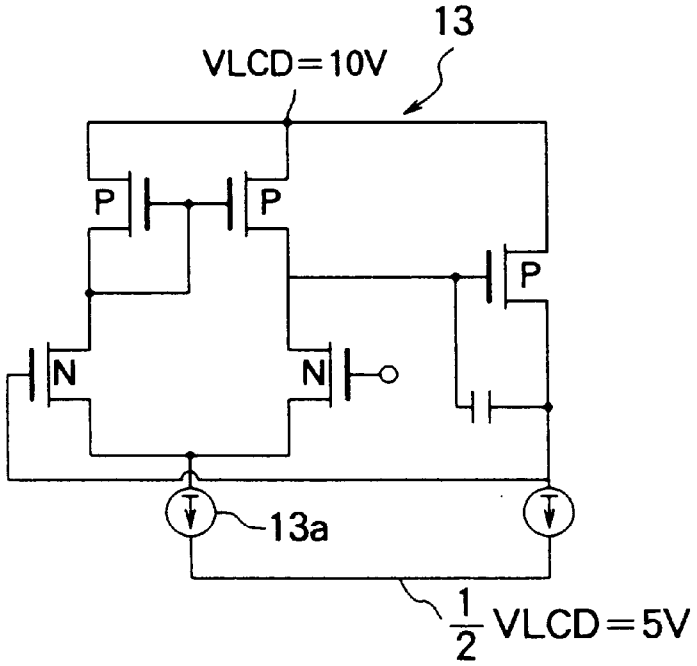
FIG. 10 is a circuit diagram showing a specific circuit configuration of a high-voltage operational amplifier.
Figure 11:
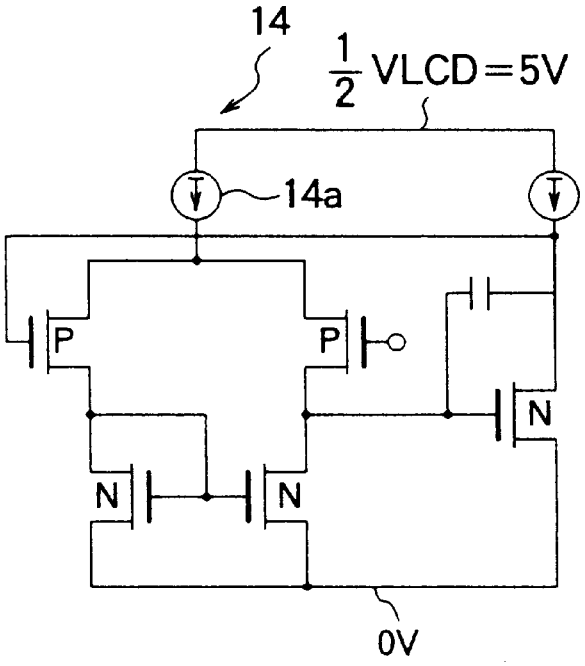
FIG. 11 is a circuit diagram showing a specific circuit configuration of a low-voltage operational amplifier.

The decoder/gray-level voltage select circuit 6, on the other hand, includes two selectors including a high-voltage decoder/gray-level voltage select circuit 11 and a low-voltage gray-level voltage select circuit 12. The decoder/gray-level voltage select circuit 6, as shown in FIG. 7, is supplied with the$2^n$ values of the gray-level voltage output from the two gray-level voltage generating circuits 17, 18 as reference voltages S. These signals are applied to the decoder section D which decode it into voltages corresponding to$2^n$ gray-level signals, or in the present embodiment, 64 gray-level signals associated with n of 6 bits. One of these values is selected, amplified by an operational amplifier OP, and applied to an operational amplifier 7 in a subsequent stage A total of m operational amplifiers 7 are provided including pairs of a high-voltage operational amplifier 13 and a low-voltage operational amplifier 14. Specific examples of the operational amplifier 7 are shown in FIGS. 10 and 11. The operational amplifier shown in FIG. 10 is a high-voltage operational amplifier 13, and the operational amplifier shown in FIG. 11 is a low voltage operational amplifier 14. The differential input stages of the operational amplifiers 13, 14 shown in FIGS. 10, 11 are configured of transistors of different conduction types.

Figure 12:
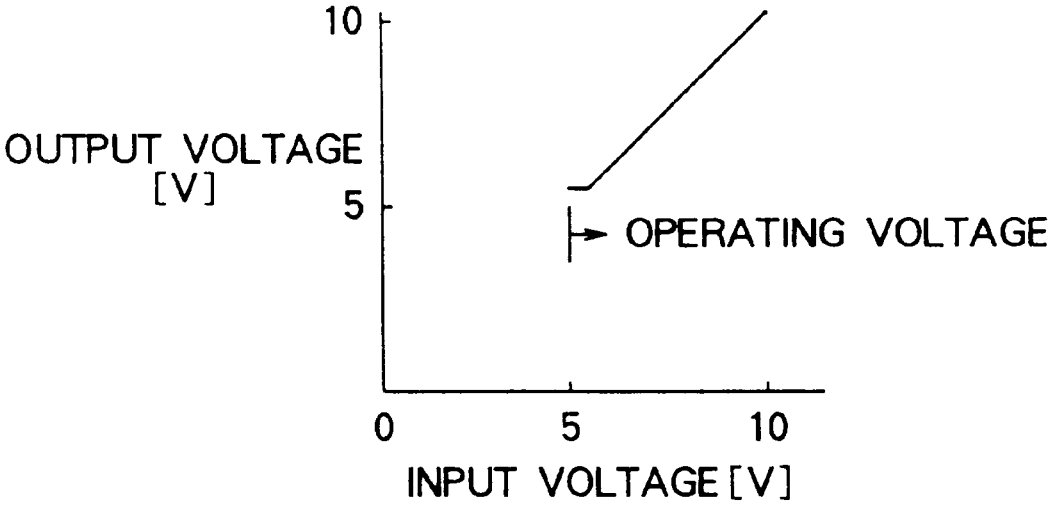
FIG. 12 is a characteristic diagram showing an input/output characteristic of the high-voltage operational amplifier.
Figure 13:
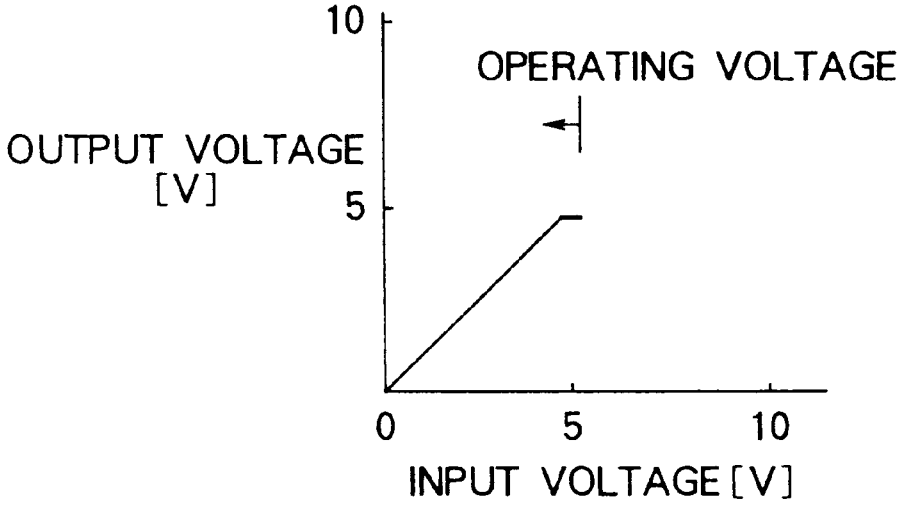
FIG. 13 is a characteristic diagram showing an input/output characteristic of the low-voltage operational amplifier.

The two types of operational amplifiers including the high-voltage operational amplifier 13 and the low-voltage operational amplifier 14 distribute the amplified output voltage between the low-voltage and high-voltage sides. As shown in FIG. 12, the high-voltage operational amplifier 13 is impressed with an input voltage of, say, 5 V and amplifies and outputs it in the range of 5 V to 10 V. Also, as shown in FIG. 13, the low-voltage operational amplifier 14 is supplied with an input voltage of, say, 0 to 3.3 V and amplifies and outputs it in the range of 0 to 5 V. The switch circuit section 8 is shared by the two terminals of the two liquid crystal drive circuits A, and is controlled in such a way as to supply each terminal with positive and negative voltages on time basis and thus to produce a voltage to hold positive and negative amplitudes at the two terminals, respectively. Also, the switch circuit section 8 shares a common terminal switch 8*a*, which is connected to all the output terminals Y1 to Ym of the liquid crystal drive circuit A thereby to reduce the voltage of all the output terminals Y1 to Ym to one half of the liquid crystal drive voltage. The common terminal switch 8*a* is connected to current sources 13*a*, 14*a* of the operational amplifiers 13, 14 shown in FIGS. 10 and 11, respectively, to reduce all the output terminals Y1 to Ym of the liquid crystal drive circuit A to a voltage one half of the liquid crystal drive voltage, i.e., to 5 V in the embodiment under consideration. The breakdown voltage of each switch circuit 8 directly connected to the liquid crystal is set to at least double the threshold voltage of the liquid crystal.

Figure 3B:
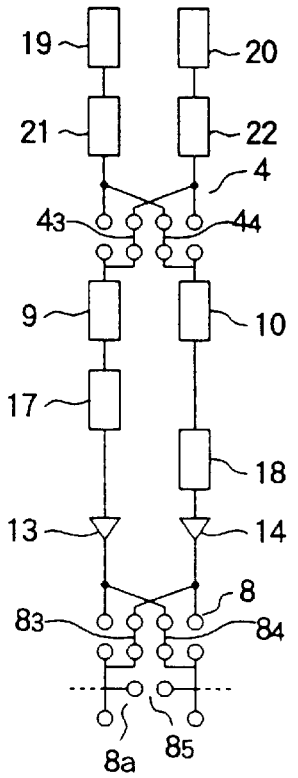
Figure 3C:
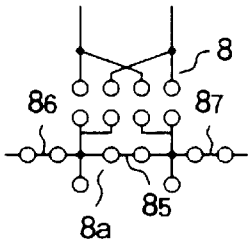
Figure 4:
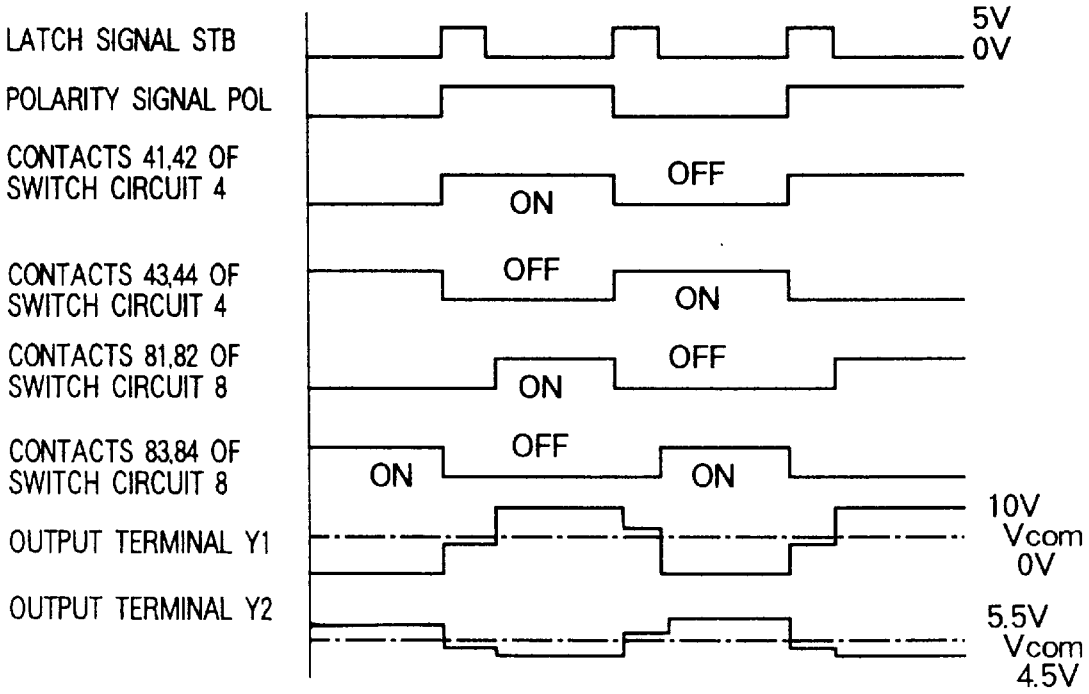
FIG. 4 shows a timing chart for the circuit of FIG. 2.

FIGS. 3A, 3B and 3C are diagrams showing the switching control of the circuit of FIG. 2 at each timing, and FIG. 4 is a timing chart for the circuit shown in FIG. 2.

Now, the source voltage of each circuit is described below. In FIGS. 3A, 3B and 3C, the voltage across the data register circuits 19, 20, the latch circuits 21, 22 and the switch circuit 4 is limited to the range of 0 V to 3.3 V. The high-voltage level shift circuit 9 boosts the input voltage of 0 V to 3.3 V to the output voltage of 0 V to 10 V, while the low-voltage level shift circuit 10 boosts the input voltage of 0 V to 3.3 V to the output voltage of 0 V to 5 V. Also, the voltage across the high-voltage decoder/gray-level voltage select circuit 11 and the operational amplifier 13 is limited to the range of 5 V to 10 V, while the voltage of the low-voltage decoder/gray-level voltage select circuit 12 and the operational amplifier 14 is limited to the range of 0 V to 5 V. The voltage across the switch circuit 8, on the other hand, is limited to the range of 0 V to 10 V. Also, the voltages applied as external inputs to the high-voltage side and low-voltage side gray-level voltage generating circuits 17, 18 include V0 of 10 V, V4 of 5.5 V, V5 of 4.5 V and V9 of 0 V. The external inputs V1, V2, V3, V6, V7, V8 are open.

Now, the operation of the first embodiment of the invention will be explained with reference to FIGS. 2, 3A, 3B and 3C. 4. A video data of 6 bits (64 gray-levels) will be referred to, as an example, for detailed explanation of the operation.

The polarity signal POL and the latch signal STB applied to the timing control circuit 15 cause the switch circuit 4 and the switch circuit 8 to turn alternately as shown in FIGS. 3A, 3B and 3C. The liquid crystal electrode thus is supplied with positive and negative voltages alternately depending on which of the two liquid crystal drive circuits A constitutes, the route of the 64-gray-level video data.

Also, as shown in FIGS. 3C and 4, during the time when the latch signal STB applied to the timing control circuit 15 is at "high" (H) level, the contacts 81, 82, 83, 84 are turned off by the switching operation of the switch circuit 8, and the contacts 85, 86, 87 are turned on. Thus all the output terminals Y1 to Ym of the liquid crystal drive circuit A are set to 5 V, according to this embodiment, which is one half the liquid crystal drive voltage.

More specifically, suppose that the six data register circuits 19 connected to the output terminal Y1 of the liquid crystal drive circuit A always hold a "low" (L) level data and that the six data register circuits 20 connected to the output terminal Y2 of the liquid crystal drive circuit A always hold a "high" (H) level data. When the polarity signal POL applied to the timing control circuit 15 is "high" (H), the contacts 81, 82, 83, 84 of the switch circuit 8 are turned off and the contacts 85, 86, 87 thereof are turned on by the latch signal STB.

In the process, as shown in FIGS. 3A and 4, the contact 41 of the switch circuit 4 turns on and the contact 43 thereof turns off. The "low" (L) level data held in the data register circuit 19 is transferred from the latch circuit 21 through the switch circuit 4 to the level shift circuit 9. Then, the gray-level voltage VR1 of 10 V is selected by the decoder/gray-level voltage select circuit 11 and current-amplified by the operational amplifier 13. As soon as the latch signal STB turns to L, the contact 81 of the switch circuit 8 turns on, and the contacts 85, 86 turn off. As a result, video data are output at the output terminal Y1 of the liquid crystal drive circuit A through the switch circuit 8, so that a predetermined gray-level voltage VR1 of 10 V is applied to the liquid crystal E shown in FIGS. 14A and 14B.

Also, as shown in FIGS. 3A and 4, the contact 42 of the switch circuit 4 turns on. The gray-level voltage VR65 of 4.5 V is selected by the decoder/gray-level voltage select circuit 12 and current-amplified by the operational amplifier 14.

Video data are thus output to the output terminal Y2 of the liquid crystal drive circuit A through the contact 82 of the switch circuit 8. Thus a gray-level voltage VR65 having a predetermined voltage value of 4.5 V is applied to the liquid crystal E shown in FIG. 14A or 14B.

As described above, outputs are alternately applied to the first line of the liquid crystal E in FIG. 14A or 14B from all the output terminals Y1, Y2 of the liquid crystal drive circuit A, after which the polarity signal POL turns to "low" (L) level in the next line of the liquid crystal E as shown in FIG. 3B. The gray-level voltage VR128 of 0 V thus is selected by the decoder/gray-level voltage select circuit 12, and current-amplified by the operational amplifier 14. As a result, the predetermined gray-level voltage VR128 of 5.5 V is applied to the liquid crystal E through the contact 83 of the switch circuit 8.

Also, the contact 44 of the switch circuit 4 turns on, and the gray-level voltage VR64 of 5.5 V is selected by the decoder/one voltage select circuit 11 and current-amplified by the operational amplifier 13. Thus, a predetermined voltage VR6 of 5.5 V is applied to the liquid crystal E through the contact 84 of the switch circuit 8.

The video data of course are replaced for each bit. In this way, the liquid crystal is driven in AC drive by controlling the switching between the two circuits of the liquid crystal drive circuit section A.

The source-gate voltage of the transistor constituting the decoder/gray-level voltage select circuit 6 and the operational amplifier 7 is limited to 5 V. These component parts, therefore, is fabricated by the diffusion process with a low breakdown voltage. The diffusion process with a high breakdown voltage, however, can alternatively be used for fabrication of these component parts as required.

Figure 15:
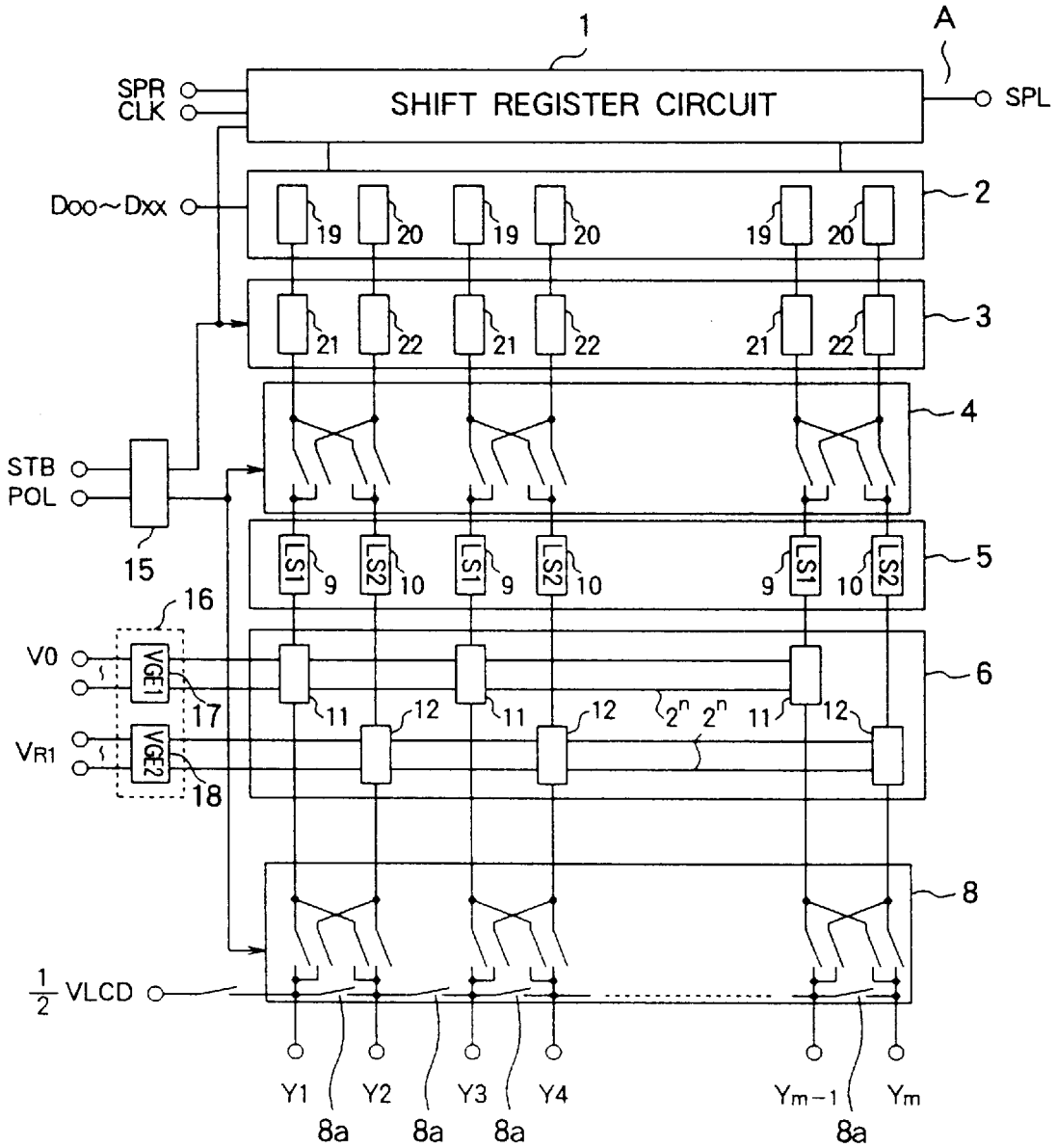
FIG. 15 is a block diagram showing a circuit configuration of a matrix liquid crystal display according to a second embodiment of the invention.

FIG. 15 is a block diagram showing a matrix liquid crystal display according to a second embodiment of the invention.

The matrix liquid crystal display according to the second embodiment shown in FIG. 16B lacks the operational amplifier 7 provided in the matrix liquid crystal display according to the first embodiment shown in FIG. 2. The operation of the second embodiment is identical to that of the first embodiment except that in the present embodiment, current is not amplified by the operational amplifier 7.

It will thus be understood from the foregoing description that according to the invention, the transistor making up a decoder/gray-level voltage select circuit or an operational amplifier, especially, the liquid crystal drive circuit can be triggered with a low voltage of 5 V between the source and the gate thereof. Thus the liquid crystal drive circuit can thus be fabricated in a process of a low breakdown voltage. Consequently, the transistor making up the liquid crystal drive circuit can be reduced for a smaller chip size.

Further, the apparatus can be operated with a voltage one half the liquid crystal drive voltage supplied in accordance with the video data applied thereto, and thus the power consumption thereof can be reduced considerably.

Also, if the differential input stages of the two operational amplifiers arranged in the liquid crystal drive circuit are configured of transistors of different conduction types, then the dynamic range for driving the liquid crystal can be widened. As a consequence, the voltage supplied to the liquid crystal can be reduced by 1 V to 1.5 V, thereby reducing the power consumption of the liquid crystal drive circuit. Also, a lower voltage supplied to the liquid crystal increases the efficiency of the CD—DC converters in the liquid crystal module, thereby contributing to a further reduced power consumption.

What is claimed is:

1. A matrix liquid crystal display comprising:

a liquid crystal drive circuit, said liquid crystal drive circuit having two circuit configurations for producing positive and negative voltages and means for selecting between a voltage of one half a supplied liquid crystal drive voltage and a voltage corresponding to a common electrode of the liquid crystal, said liquid crystal driving circuit producing said positive and negative voltages on a basis of said one of said one half the supplied liquid crystal drive voltage and said voltage of a common electrode of the liquid crystal as selected by said selecting means; and a switch circuit, said switch circuit having two terminals connected to the two circuit configurations of said liquid crystal drive circuit, and being controlled in such a manner that said positive and negative voltages are output at each terminal on a time basis and a voltage is produced to hold the two terminals in positive and negative stress, respectively.

2. A matrix liquid crystal display according to claim 1, wherein said switch circuit is directly connected to a liquid crystal and is set to a breakdown voltage at least twice as high as a threshold voltage of the liquid crystal.

3. A matrix liquid crystal display according to claim 1, wherein said liquid crystal drive circuit includes two types of operational amplifiers, and differential input stages of the two types of the operational amplifiers include transistors of different conduction types.

4. A matrix liquid crystal display according to claim 1, wherein said liquid crystal drive circuit includes two types of gray-level voltage generating circuits, and a gray-level voltage generated by the gray-level voltage generating circuits for indicating a gray-level on a liquid crystal is finely adjusted in response to an external input.

5. A matrix liquid crystal display according to claim 1, wherein said liquid crystal drive circuit includes two types of level shift circuits for increasing the liquid crystal drive voltage to different voltage levels.

6. A matrix liquid crystal display according to claim 4, wherein the gray-level voltage generated by said gray-level voltage generating circuits is finely adjusted to a resistance ratio in such a manner as to meet a $\gamma$ curve of the liquid crystal by a resistance-dividing method.

7. A matrix liquid crystal display according to claim 1, wherein said switch circuit includes a common terminal switch shared by all output terminals of said liquid crystal drive circuit for reducing all the output terminals to one half the liquid crystal drive voltage.

8. A liquid crystal drive circuit for a matrix liquid crystal display, comprising:

means for supplying data bits;

a drive circuit for generating positive and negative voltages for output to output terminals of said liquid crystal display, said drive circuit generating said positive and negative voltages based on a voltage of a common electrode of said liquid crystal display, said drive circuit including:

a first switching circuit for switching a data bit from said supplying means along one of two paths in response to a control signal;

a first voltage level shift circuit, disposed along said first path, for shifting said data bit to a first voltage level when said first switching circuit switches to said first path;

a second voltage level shift circuit, disposed along said second path, for shifting said data bit to a second voltage level when said first switching circuit switches to said second path, said first voltage level being greater than said second voltage level; and a second switching circuit for switching said data bit output from one of said first path and said second path that was switched to by said first switching circuit to a first one of said output terminals in response to said control signal.

9. A liquid crystal drive circuit according to claim 8, wherein said drive circuit includes means for selecting between one half of a supplied liquid crystal drive voltage and said common electrode voltage, said driving circuit generating said positive and negative voltages based on which of said voltages is selected by said selecting means, and wherein, if said selecting means selects said one half of a supplied liquid crystal voltage, said second switching circuit disconnects said first output terminal from said first path and said second path and connects said first output terminal to a terminal supplying said one half of said supplied liquid crystal drive voltage.

10. A liquid crystal drive circuit according to claim 9, wherein said drive circuit generates positive and negative voltages for output to a second one of said output terminals of said liquid crystal display, said drive circuit generating said positive and negative voltages to sid second output terminal based on said common electrode voltage, said driving circuit including:

a third switching circuit for switching a second data bit from said supplying means along one of said first path and said second path in response to said control signal; and a fourth switching circuit for switching said second data bit output from one of said first path and said second path that was switched to by said third switching circuit to said second output terminal in response to said control signal.

11. A liquid crystal drive circuit according to claim 10, wherein said drive circuit includes a second means for selecting between said one half of a supplied liquid crystal drive voltage and said common electrode voltage, said second driving circuit generating said positive and negative voltages based on which of said voltages is selected by said second selecting means, and wherein, if said second selecting means selects said one half of a supplied liquid crystal voltage, said fourth switching circuit disconnects said second output terminal from said first path and said second path and connects said second output terminal to said terminal supplying said one half of said supplied liquid crystal drive voltage.

12. A liquid crystal drive circuit according to claim 8, further comprising:

a gray-level voltage generating circuit disposed between each of said first voltage level shift circuit and second voltage level shift circuit and said second switching circuit, said gray-level voltage generating circuit adjusting outputs of said first voltage level shift circuit and said second voltage level shift circuit to one of$2^n$ gray level values, wherein n=a number of data bits supplied by said supplying means.

13. A liquid crystal drive circuit according to claim 12, further comprising:

an operational amplifier circuit disposed at an output of said gray-level voltage generating circuit, said operational amplifier circuit including a first operational amplifier disposed along said first path for amplifying said output of said gray-level voltage generating circuit to a first predetermined voltage and a second operational amplifier disposed along said second path for amplifying said output of said gray-level voltage generating circuit to a second predetermined voltage.

14. A liquid crystal drive circuit according to claim 10, wherein said control signal includes at least one of a polarity signal and a timing signal.

* * * * *